US006053497A

United States Patent [19]

Such

[11] Patent Number: 6,053,497

[45] Date of Patent: Apr. 25, 2000

[54] GAME OF CHANCE KIT

[75] Inventor: David A. Such, Great Falls, Mont.

[73] Assignee: D. Allan Such & Associates, Inc., Great Falls, Mont.

[21] Appl. No.: 09/226,288

[22] Filed: Jan. 7, 1999

Related U.S. Application Data

[60] Provisional application No. 60/070,664, Jan. 7, 1998.

[51] Int. Cl.[7] ..... A63F 3/06

[52] U.S. Cl. ..... 273/138.1; 273/139; 273/144 R; 273/144 A

[58] Field of Search ..... 273/139, 138.1, 273/269, 144 R, 144 A, 144 B, 148 R, 148 A

[56] References Cited

U.S. PATENT DOCUMENTS 5,046,737 9/1991 Fienberg ..... 273/139

5,671,921 9/1997 Quinlan ..... 273/139

OTHER PUBLICATIONS

Baazar & Novelty catalog, Stuart Entertainment, Ontario, Canada, pp. 108–109, Oct. 1995.

Universal Manufacturing Company brochure, Kansas City, MO., "Jar Tickets", Oct. 1997.

*Primary Examiner*—Benjamin H. Layno
*Attorney, Agent, or Firm*—Webb Ziesenheim Logsdon Orkin & Hanson, P.C.

[57] ABSTRACT

A game package comprises a lottery ticket set, a plastic or glass bowl or container for holding the entire lottery ticket set and having an opening to accommodate most human hands, a lid for the bowl and a tamper proof seal comprising a tape with an adhesive backing that cannot be removed from the bowl and cover once applied without the use of a solvent.

3 Claims, 1 Drawing Sheet

GAME OF CHANCE KIT

RELATED APPLICATION

This application claims the benefit of U.S. Provisional Patent Application Ser. No. 60/070,664, filed Jan. 7, 1998.

BACKGROUND OF THE INVENTION

This invention is directed to a game of chance kit and, more particularly, to a game kit for use by charitable organizations, clubs and taverns and the like whereby members or customers can purchase a ticket and instantly win a prize if the ticket is a "winner". These kits are sold through licensed distributors in states where such games are legal. Typically, the kit is purchased by the charitable organization, club or tavern, the tickets are sold and the instant prizes are paid by the kit purchaser. The number of winners is precisely controlled so that the income from ticket sales will exceed the total cost of the instant prizes and so that the ticket purchasers will know in advance the payout if all tickets are purchased.

Traditionally, game of chance kits have been sold to the distributor in flexible plastic bags that are heat sealed so that the integrity of the game set is insured until the organization that sells the tickets opens a bag. Typically the organization must then find a suitable bowl, jar or container to dump the ticket sets into so that the tickets can be dispensed one at a time (ticket or game packet is glued together). This can be a drawback to the sale of the game sets relative to other types of game sets since the organization is left to find a suitable bowl and in the handling of a bagged ticket set and the placing of the ticket set into a bowl, the integrity of the ticket set may be inadvertently destroyed. Also, it is important to have the rules of the game fairly posted on or near the container for the game set. The organization must find a place to post the rules flair or poster. The rules flair or poster may, only by chance, be of a size that it can be fixed to the container chosen for dispensing the tickets. Thus, it is possible that the rules flair or poster will be lost and the organization will inadvertently violate regulations requiring that the rules flair or poster remain near the location where the tickets are dispensed.

It is an object, according to this invention, to provide a game kit that overcomes the drawbacks described above.

SUMMARY OF THE INVENTION

Briefly, according to this invention, there is provided a lottery game kit comprising a container for a set of game tickets of a preselected number which tickets can be purchased by game players. Each ticket has concealed indicia (symbols or numbers), some of which indicate entitlement to an instant prize and/or eligibility for a remote sweepstakes drawing. Each ticket contains indicia of a particular game set. A game set comprises all tickets in one container including both winners and losers. The game package, according to this invention, preferably comprises:

a) a lottery ticket set selected from the group single break-open tickets, packets of single break-open tickets, multiple break-open tickets and banded tickets, b) a plastic or glass bowl or container for holding the entire lottery ticket set and having an opening at least three inches in diameter to accommodate most human hands, c) a snap-on or twist-on lid for the bowl, and d) a tamper-proof seal comprising a tape with an adhesive backing that cannot be removed from the bowl and cover once applied without the use of a solvent.

BRIEF DESCRIPTION OF THE DRAWINGS

Further features and other objects and advantages of this invention will be made clear by the following detailed description made with reference to the drawings in which.

DESCRIPTION OF THE PREFERRED EMBODIMENTS

Figure 1A:
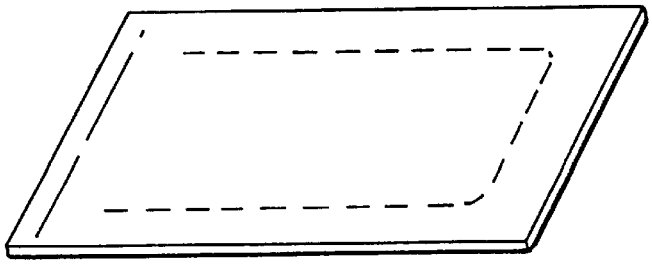
FIGS. 1*a* and 1*b* show single game tickets and ticket packets that may comprise one type of game set useful according to this invention.
Figure 1B:
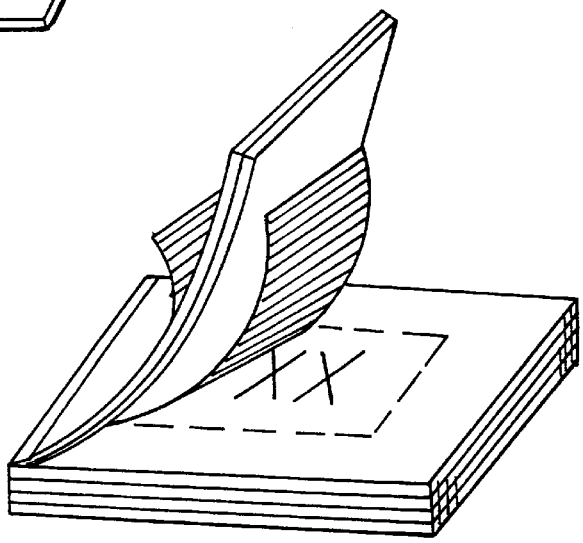

Referring now to FIGS. 1*a* and 1*b,* there are shown tickets which include a laminated upper and lower layer of material such that until torn apart by removing a tab, the indicia (symbols or numbers) hidden therein are not visible. Alternately, the ticket may be folded and sealed such that until the seal is unbroken and the ticket unfolded, the hidden indicia are not visible. The particular tickets illustrated in FIGS. 1*a* and 1*b* are referred to in the industry as pull-tabs. Other types of tickets are suitable for use in game kits according to this invention.

The indicia of the game set on each eligible ticket enables an audit of the drawing to reduce the opportunity for fraudulent entries.

There must be a rules flair or poster which sets forth the rules and the value of instant winning tickets. The rules flair or poster displays a number of winners and the number of total tickets in each game set and any other information required by state laws.

Figure 2:
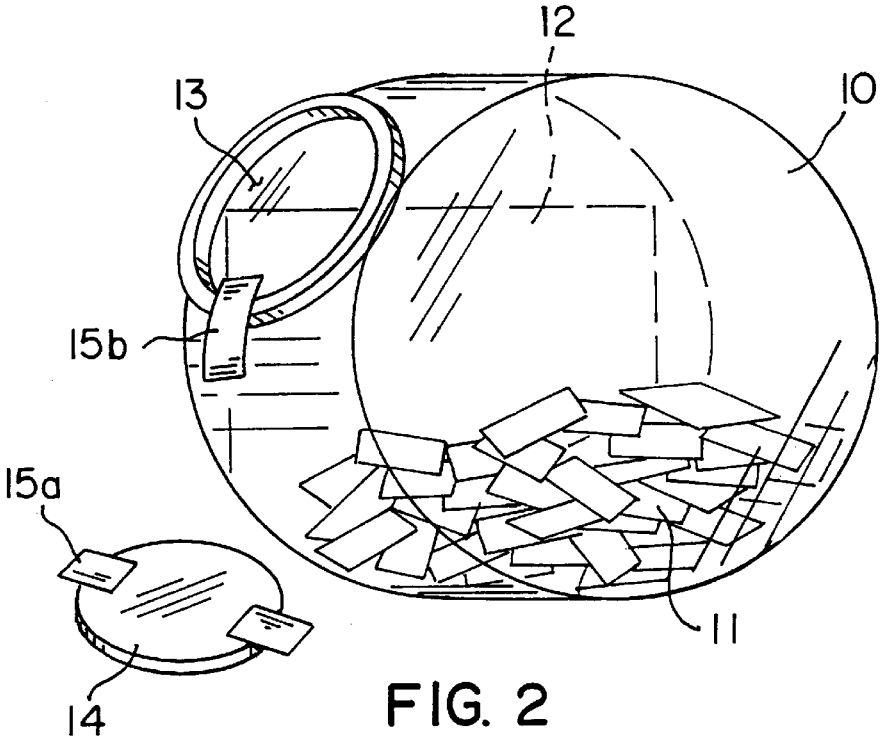
FIG. 2 shows a game package according to this invention.

Referring to FIG. 2, there is shown a transparent fish bowl type container 10 containing a ticket set 11. Seen through the bowl is the backside of a rules flair or poster 12 attached to one side of the bowl. The bowl has an opening 13 that is at least about three inches in diameter to enable the hand to pass therethrough. A snap-on lid 14 is shown removed from the opening of the bowl. A seal is shown torn apart, one part 15*b* still stuck to the bowl and one part 15*a* stuck to the lid. As shipped, the lid 14 would be in place, the seal unbroken and the entire package would be contained in a shrink wrapped plastic envelope.

Having thus described my invention with the detail and particularity required by the Patent Laws, what is requested protected by Letters Patent is set forth in the following claims.

I claim:

1. A game package comprising:

a) lottery ticket set;

b) a bowl or container for holding the entire lottery ticket set;

c) a lid for the bowl; and d) a tamper-proof seal for the lid.

2. A game package comprising:

a) lottery ticket set;

b) a bowl or container for holding the entire lottery ticket set;

c) a lid for the bowl;

d) a tamper-proof seal for the lid; and e) a shrink wrapped plastic envelope enclosing the bowl, lid and seal.

3. A game package comprising:

a) lottery ticket set selected from the group single break-open tickets, packets of single break-open tickets, multiple break-open tickets and banded tickets;

b) a plastic or glass bowl or container for holding the entire lottery ticket set and having an opening at least three inches in diameter to accommodate most human hands;

c) a snap-on or twist-on lid for the bowl; and d) a tamper proof seal comprising a tape with an adhesive backing that cannot be removed from the bowl and cover once applied without the use of a solvent.

* * * * *